US005528792A

United States Patent [19]

Nazemi

[11] Patent Number: 5,528,792

[45] Date of Patent: Jun. 25, 1996

[54] AXIALLY PIVOTABLE DUAL CONFIGURATION SHOWER BRUSH

[76] Inventor: Ataollah F. Nazemi, 7101 Ridgeleigh Ct., Baltimore, Md. 21212

[21] Appl. No.: 353,891

[22] Filed: Dec. 12, 1994

[51] Int. Cl.[6] ..... A46B 5/02; A46B 15/00

[52] U.S. Cl. ..... 15/160; 15/143.1; 15/144.1; 15/145; 15/172

[58] Field of Search ..... 15/143.1, 144.1, 15/145, 160, 167.1, 172, 176.1, 176.6, 222

[56] References Cited

U.S. PATENT DOCUMENTS

| | | | |
|---|---|---|---|
| 1,532,522 | 4/1925 | Weaver, Jr. | 15/172 |
| 3,935,611 | 2/1976 | Locher | 15/160 |

FOREIGN PATENT DOCUMENTS

| | | | |
|---|---|---|---|
| 2433140 | 1/1975 | Germany | 15/160 |
| 1722433 | 3/1992 | U.S.S.R. | 15/172 |

*Primary Examiner*—David Scherbel
*Assistant Examiner*—Randall E. Chin
*Attorney, Agent, or Firm*—Peter Gibson

[57] ABSTRACT

A shower brush with a handle at one end and a group of bristles located upon one face at the other end has an axial pivot medial to two ninety degree bends taken with respect to the longitudinal axis of the shank. U-shaped and a S-shaped configurations are thus enabled, each being obtained from the other by rotation of one shank portion relative to the other through one hundred eighty degrees in either direction about the axial pivot. Each configuration may be secured to prevent accidental rotation and the pivot maintains the rotatable disposition of one shank portion in relation to the other. A relatively large hand grip, preferably having a resilient exterior, facilitates comfortable gripping. The U-shaped configuration is intended to facilitate scrubbing of one's back while a shower or bath utilizing a reciprocating motion of the hand gripping the handle frontally. The S-shaped configuration is intended to facilitate scrubbing of one's lower extremities in a shower or bath without bending of one's torso. Use of tubular plastic members with a pivot effected by the insertion of a reduced exterior diameter of one shank end into an open end of the other shank permits inexpensive, durable and water resistant construction.

12 Claims, 3 Drawing Sheets

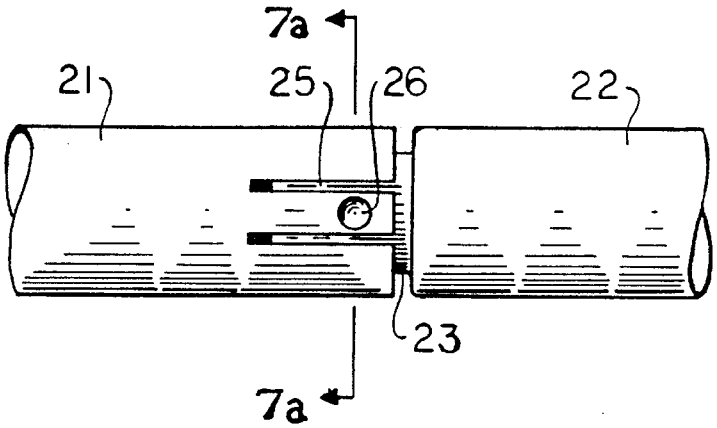
FIG 5
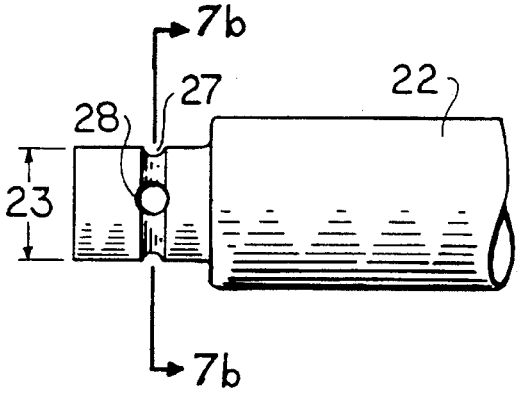
FIG 6
FIG 7a
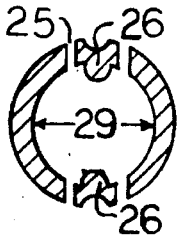
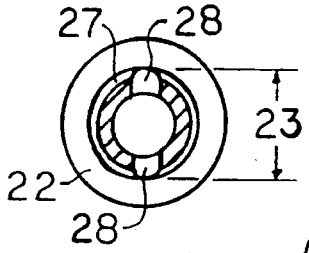
FIG 7b
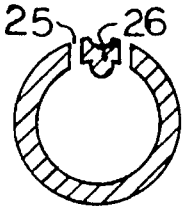
FIG 7c

AXIALLY PIVOTABLE DUAL CONFIGURATION SHOWER BRUSH

BACKGROUND OF THE INVENTION

1. Field of the Invention

The general field of the present invention is that of brushes for scrubbing and general cleaning, more particularly brushes used in a shower or bath and specifically brushes used manually in a shower or bath possessing a handle at one end, a grouping of bristles proximate the other end and a pivot therebetween.

2. General Background

It is first considered that a brief discussion of the fundamental problems most concerned with regard to the relevant prior art and of the various approaches with which these problems have been addressed in the prior art will, perhaps, best set forth the general background of the present invention.

Brushes intended for manual use in a shower are generally characterized by a long rigid handle which enables one to scrub their back and also to scrub one's lower extremities while standing. The first function generally requires elevation of one arm and bending of the elbow to position the hand gripping the brush handle above one's shoulders. The second function generally requires bending of one's torso. The bending required of both functions is uncomfortable to many people, difficult for many people and presents a problem to people lacking full mobility such as those afflicted by decreased range of muscular skeletal mobility resulting from bursitis, arthritis, stiff joints, obesity, etc.

The difficulty of effectively scrubbing one's back, regardless of any lack of mobility, is a problem which has been widely addressed by various contrivances. One approach is to utilize a flexible medial portion intended for scrubbing with a handle at either end intended for grasping with both hands. Other devices require mounting upon a wall or other structure and rely upon a variety of mechanisms for the displacement necessary to obtain a scrubbing action. The problem of having to bend in order to scrub one's lower extremities while standing in a shower has basically been addressed by the provision of a long shank to a single handled brush.

It is further considered that many people lacking full muscular skeletal mobility often experience pain, discomfort or other difficulty in grasping the handle typically provided such brushes, particularly those of the flexible variety having two handles. The basic problem of having to crook an arm such that a hand grasping the single handle of a rigid brush is disposed above one's shoulders has been addressed by a variety of approaches, however.

DISCUSSION OF THE PRIOR ART

Numerous examples exist in the prior art of contrivances facilitating the scrubbing of one's back either sitting in a bath or standing in a shower without having to reach a hand up above one's shoulders. The dual handled strap approach was mentioned above. U.S. Pat. No. 2,505,610 issued to F. H. Ellinger on Apr. 25, 1950 for a 'Soap Dispensing Back Scrubbing Brush' and U.S. Pat. No. 2,905,957 issued to A. M. Volpe on Sep. 29, 1959 for a 'Back Brush' provide examples of this approach. Ellinger and Volpe both disclose dual handled devices with the brush or bristled portion therebetween, both intended for scrubbing backs. Other devices locate a brushing surface by means of attachment to a wall or other support structure.

Several references of this last description further possess a pivot in construction, typically at the point of attachment to a support structure, in order to allow one to displace a brushing surface against one's back by displacement of a brush handle located in front of one's person. The single most pertinent reference with regard to the present invention is considered by both the inventor and the present author to be U.S. Pat. No. 5,105,484 issued to Forsythe on Apr. 21, 1992 for a 'Back Scrubber Device'. Forsythe discloses a U shaped extension possessing a bristled face at one end and a handle upon the other medially mounted by means of a horizontally oriented pivot which, located upon a support structure, enables rotation of the axis of this extension within a substantially vertical plane. Upward and downward displacement of the handle frontal one's person effects, respectively, a downward and an upward displacement of the bristled face placed against one's back as translated by the pivot fixed to a support structure.

Other brushes possessing a U shaped configuration, such as U.S. Pat. No. 606,184 issued to J. T. Burnip on Jun. 28, 1898 for a 'Brush', are concerned with scrubbing the opposed surfaces of an object which is displaced. A bicycle chain is the specific object of the disclosure made by Burnip and later similar disclosures typically address objects displaced more directly by means of rotation, such as the rim of a wheel to a either a bicycle or an automobile.

Other brushes are readily found possessing a quarter circle arc in the shank. Of these, the most pertinent is considered to be the invention given U.S. Pat. No. 2,187,977 issued to B. E. Large on Jan. 23, 1940 for a 'Back Washer' which discloses a quarter circle of curvature in a handle pivotally mounted to a bath tub for scrubbing one's back. An early reference disclosing a brush possessing a curved shank of about one quarter circle may be found in U.S. Pat. No. 431,486 issued to E. M. Ryan on Jul. 1, 1890 for a 'Bath or Flesh Brush' which discloses a curved handle, of up to about a quarter circle, with a detachable brush. Another reference, U.S. Pat. No. 2,039,052 issued to R. W. Beck et alii on Apr. 28, 1936 for a 'Resilient Means for Bath Brush' discloses a brush possessing "a resilient strip normally arcuate along its length and being substantially a quadrant in curvature", (claim 1), between the brush itself and the handle proper. Another reference within this group of rigid, arcuate handle bath and shower brushes is U.S. Pat. No. 3,935,611 issued to Locker on Feb. 3, 1976 for a 'Brush for the Care and Cleaning of Things and the Body'. Locker discloses use of two opposed curves in a rigid brush possessing a loose S-shaped configuration and has bristled areas on at least two opposed surfaces each possessing different degrees of stiffness.

Lastly, many references disclosing pivoted handles, typically for paint brushes, are readily found in the prior art; all pivot about an axis normal to the longitudinal axis of the extension member, enabling rotation within the plane of this axis, and none address the problem of scrubbing the back of one's person while grasping a handle in front of one's person.

STATEMENT OF NEED

Because it is generally desirable to brush both one's back and one's lower extremities from a convenient location frontal to one's person while standing in a shower, particularly by those lacking full muscular skeletal mobility, and because it is further desirable to provide this capability in a single brush which may be manually used, without attachment to any support structure, a need therefore exists for a brush which would facilitate both scrubbing of the back from a frontal grasping of the handle and scrubbing of the lower extremities without bending of one's torso.

SUMMARY OF THE INVENTION

The principal object of the present invention is to provide a brush which will facilitate effective manual scrubbing of both one's back and lower extremities while showering by grasping the brush at a convenient level in front of one's person and utilizing a vertically reciprocating motion which is easiest for those lacking full mobility such as those afflicted by decreased range of muscular skeletal mobility resulting from bursitis, arthritis, stiff joints, obesity, etc.

Another object of the present invention is to provide a brush for use in a shower or bath which possesses a relatively large handle diameter which is easily and comfortably grasped, especially by those afflicted with arthritis who suffer pain in grasping smaller diameters.

It is further the object of the present invention to utilize the advantages inherent to pivoting two portions of the extension comprising the shank of a brush possessing a handle extending from one end and a bristled area upon one face proximate the opposed end, each shank portion possessing an arcuate portion, the pivot therebetween thereby enabling a range of three dimensional configurations determined by the fixed dimensions of the brush combined with this rotation, thus enabling multiple, axially continuous, extension configurations.

A shower or bath brush having two ends is disclosed comprising a handle at one end, bristles arranged in a group on one face proximate the other end and a axially pivotable shank between the handle and the bristled face further comprised of two rigid shank portions each possessing an arcuate portion each of which, in the preferred embodiment, substantially describes a quarter circle. This enables a substantially U shaped configuration in one disposition and a substantially S shaped configuration in a fully opposed disposition. Rotation of one brush shank one hundred eighty degrees relative to the other brush shank about the longitudinal curvilinear axis of the brush from one position yields the other position. The closed, U shaped, configuration facilitates brushing of one's back and the extended, S shaped, configuration facilitates brushing of one's lower extremities, both while grasping the handle frontally.

A preferred embodiment of the present invention further posits locking means for both the U shaped and S shaped configurations, tubular construction and an overlapping tubular pivot. Two tubular shank sections, one having a reduced exterior diameter sized to rotate within the other tube end along with means of retaining this relation is suggested. Retention means may be simply effected by a frictional fit between the two overlapping tubular portions. With this construction locking means for maintaining the relative disposition of each brush shank to each other is readily effected by opposed detents, convexity into concavity for locking, preferably with a flexible member supporting one detent. With the convex detent flexibly held, retention means may easily be effected with an annular groove about the reduced exterior diameter within which the convex detent is held in an axially rotatable relation.

It is further suggested that a handle which possesses a relatively large diameter with regard to comfortable grasping be provided. This handle is additionally benefited by a resilient exterior surface which provides a more secure grip in grasping. In the preferred construction described above, a relatively large diameter to the handle further possessing a resilient exterior surface is readily achieved with a tubular sleeve of closed cell foam rubber possessing a relatively large exterior diameter and an interior diameter substantially equivalent to the exterior diameter of the brush shank at the handle end.

Since the brush is intended for use in a shower, primarily, it is considered that water resistant materials be used in construction. Comprehension of less obvious aspects and a fuller appreciation of the principles relating to the present invention may be readily achieved with a reading of the detailed description below with reference to the related drawings attached hereto, and, it is trusted, guide one practiced in the art in the construction and use of an embodiment of said principles.

BRIEF DESCRIPTION OF THE DRAWINGS

FIG. 5 is a partial plain elevational view taken from FIG. 4 illustrating a tubular axial pivot.

FIG. 6 is a partial plain elevation view taken from FIG. 5 illustrating the reduced diameter end of one shank end.

FIGS. *7a*, *7c* are cross sectional views taken from FIG. 5 illustrating the end of the enclosing sleeve.

FIG. *7b* is a cross sectional view taken from FIG. 6 illustrating the end of the reduced diameter.

DETAILED DESCRIPTION OF THE INVENTION

Figure 1:
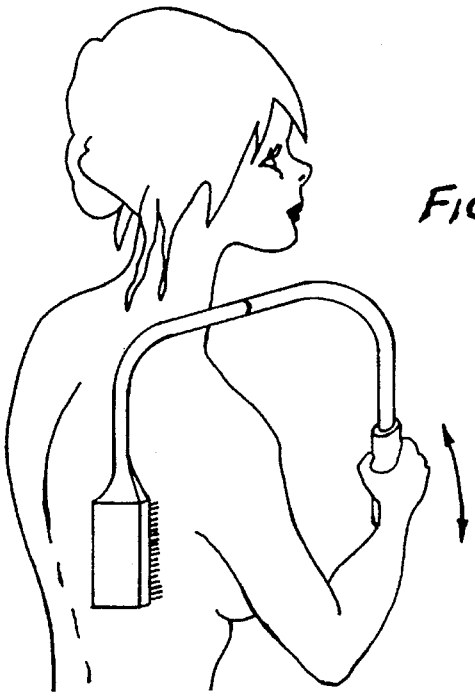
FIG. 1 is an isometric view of a standing person using an embodiment of the principles relating to the present invention in a closed, U-shaped configuration to scrub their back with a reciprocating displacement of the handle in a frontal disposition.

In reference to FIG. 1, it is readily seen that an embodiment of the principles relating to the present invention possessing a basically U shaped configuration is being utilized by a person to scrub their back while holding the handle 11 of the brush frontally. It is further seen that the bristles 12 of the brush, shown in contact with the back of the person depicted in FIG. 1, are displaced in the same direction as given displacement of the handle 11.

The configuration depicted in FIG. 1 illustrating the usage described above is also depicted in FIG. 3 wherein the arcuate portions 15 of the extension comprising the shank 20 further comprised of a handle shank 21 and a brush shank 22 held in rotatable relation about the common longitudinal and curvilinear axis by the medial axial pivot 13. It is, perhaps, further desirable to locate another, brush axial pivot 14 between the arcuate portion 15 of the brush shank 22 and the brush base 24 to which the group of bristles 12 are attached. This brush pivot 14 enables the configuration depicted in FIG. 2, as opposed to the configuration depicted in FIG. 4, although both depict an extended, S shaped configuration.

Figure 2:
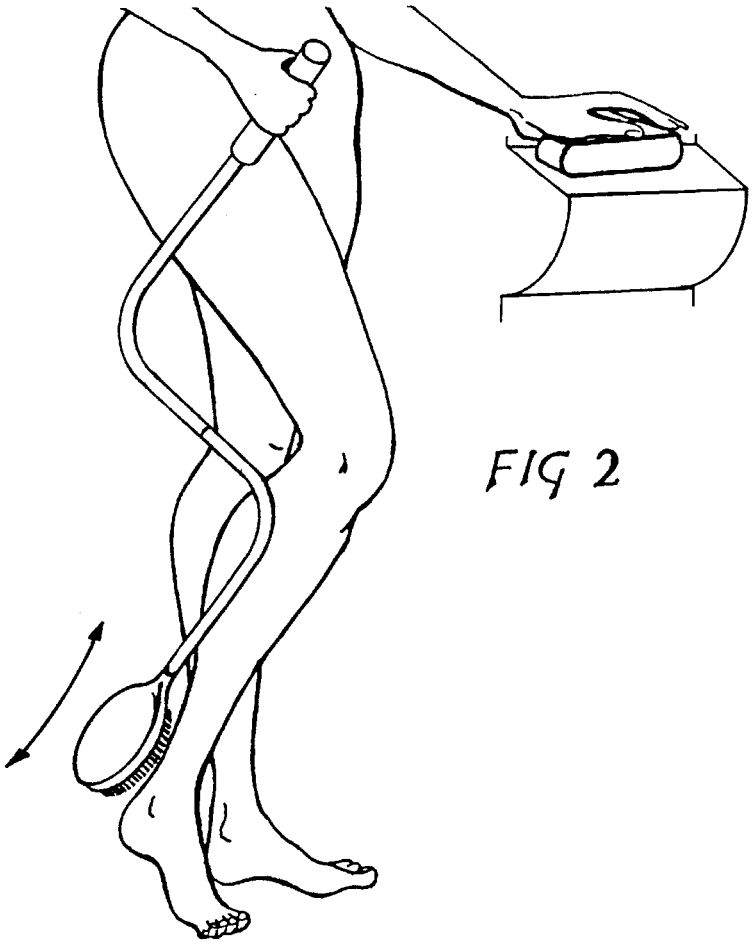
FIG. 2 is an isometric view of a standing person using an embodiment of the principles relating to the present invention in an open, S-shaped configuration to scrub their lower extremities with a reciprocating displacement of the handle in a frontal disposition.
Figure 4:
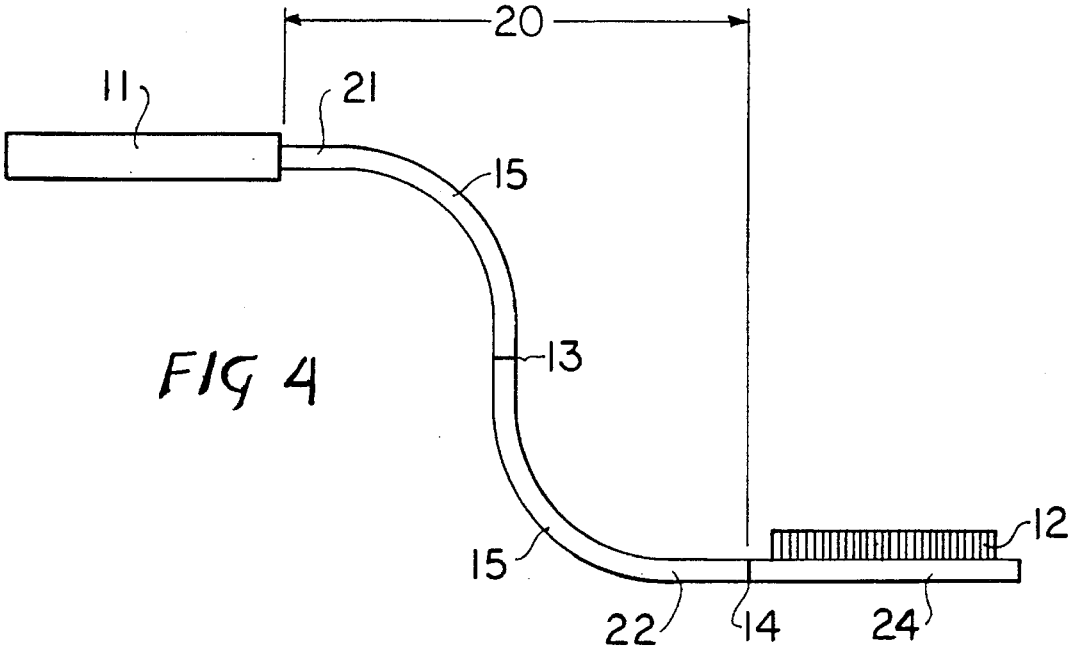
FIG. 4 is a plain elevational view taken from the side of an embodiment of the principles relating to the present invention shown in the open, S shaped configuration.

FIG. 2 depicts a usage of an embodiment of the principles relating to the present invention in an extended, S shaped configuration, wherein the bristles 12 are seen to be facing in a direction relative to the arcuate portion 15 of the brush shank 22 which is opposed to the sense had in FIG. 4. It is understood that the configuration depicted in FIG. 4 may be utilized in substantially the same fashion as depicted in FIG. 2 and, furthermore, that other possible configurations utilizing a medial axial pivot 13 and, optionally, a brush axial pivot 14 are all encompassed by the principles relating to the present invention.

Many of the features and all the details of construction described herein are discussed with regard to a preferred embodiment of the principles relating to the present invention. The handle 11 illustrated in FIG. 3 differs substantially from the handle 11 illustrated in FIG. 4 in possessing a plurality of ridges 17 aligned normal to the longitudinal axis of the handle provide increased comfort in accommodating the individual fingers of a hand in grasping an ease in transferring force parallel to the longitudinal axis of the handle. The smooth handle illustrated in FIG. 4 is generally easier and therefore less expensive to manufacture than the more complex form illustrated in FIG. 3, hence neither is preferred over the other. It is preferred in either case that a relatively large diameter 19 be given to the handle 11 as this aspect enables both increased comfort and security of grip without significant additional expense in manufacture. If is further preferred that the handle 11 possess a resilient exterior surface for the same reasons.

It is necessary to fulfillment of the principles relating to the present invention that the brush shank portion 22 and the handle shank portion 21 be held in a continuous axial relation to each other ie. in rotatable disposition with respect to the longitudinal, curvilinear axis common to the shank 20. This requires some linear, ie. longitudinal, retention means of retaining the two shank portions together by the medial axial pivot 13, either passive such as friction or some dedicated positive means. This means of retention may further be assisted by releasable locking means ie. means of resistance against unintended rotation for fixing the orientation of the shank portions with respect to each other in rotation about their common axis. A preferred embodiment of the principles relating to the present invention possesses such releasable locking means for fixing, ie. resisting unintended displacement, rotational or linear, during usage, of the brush shank 20 into two different, particular configurations, the two basic configurations depicted in FIGS. 1–4.

Figure 3:
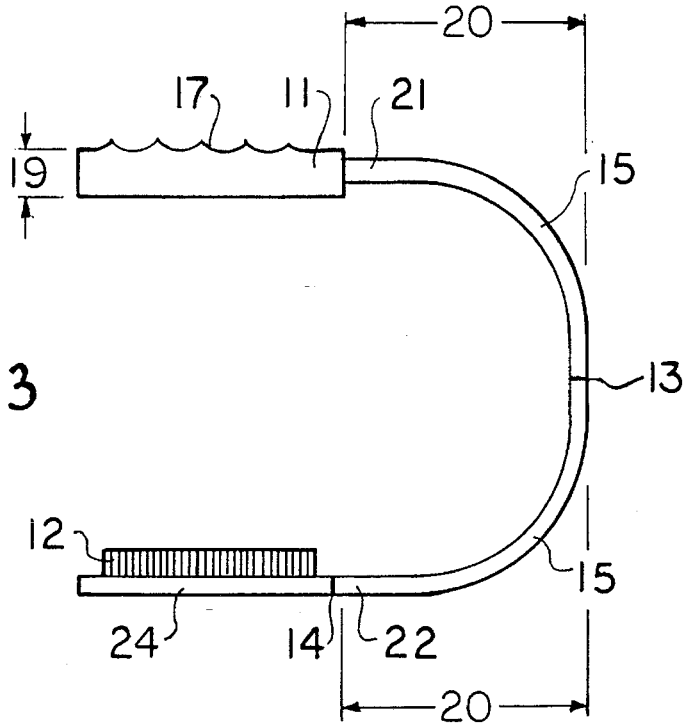
FIG. 3 is a plain elevational view taken from the side of an embodiment of the principles relating to the present invention shown in the closed, U shaped configuration.

As is readily discerned by comparison of the configurations depicted in FIGS. 3 & 4, the two basic configurations of a preferred embodiment of the principles relating to the present invention dispose the arcuate portions 15 within substantially one common plane and therefore the difference between the two configurations depicted therein is that of one hundred eighty degrees rotation about the common axis of the shank 20 of the handle shank 21 with respect to the brush shank 22. It is also noted that the arc described by each arcuate portion 15 illustrated in either FIG. 3 of FIG. 4 is substantially one quarter of a circle and that this determines the parallel disposition of the scrubbing surface of the bristles 12 with respect to the handle 11 which is generally considered desirable and thus preferred in fulfillment of the principles relating to the present invention.

The depictions of an embodiment of the principles relating to the present invention given in FIGS. 1–4 do not reveal the preferred manner of construction which is generally that of tubular plastic as seen in FIGS. 5–7 which illustrate a specific construction of the medial axial pivot 13 between the handle shank 21 and the brush shank 22. Tubular plastic construction is preferred primarily for ease and low cost in manufacture. Overall construction in plastic tubing is easily effected by the forming of tube stock to effect the arcuate portions 15 clearly seen in FIGS. 3 & 4. Construction of the handle 11, if smooth, as depicted in FIG. 4, may be effected by simply cutting a length of appropriately sized resilient material tubing, such as a closed cell urethane tubing with an interior diameter equal to the outside diameter of the rigid plastic tubing utilized for the handle shank 21 and fitting, perhaps with the aid of a water based lubricant such as a soap in water solution. Construction of the handle 11 possessing a plurality of ridges 17 perpendicular the handle axis as depicted in FIG. 3 would most easily be effected by molding.

With regard to the bristles 12, it is recognized that a plastic brush base 24, formed in a piece separate from the brush shank 22, will greatly facilitate manufacture with the preferred construction detailed herein. This enables the bristles 12 and the brush base 24 to be made in the same manner in which brushes are typically manufactured and the juncture required between the brush base 24 and the brush shank 22 may readily be a brush axial pivot 14 very similar to the medial axial pivot 13 illustrated in FIGS. 5 & 6. The preferred construction using rigid, tubular plastic shank portions suggests a medial axial pivot 13 therebetween of a type illustrated in detail in FIGS. 5–7 wherein one shank end comprises a sleeve having the same inner diameter 29 and outer diameter of the shank 20 and the other shank end possesses a reduced diameter 23 to fit into the sleeve inner diameter 29. A carefully sized reduced diameter 23 in relation to the interior diameter 29 of the sleeve, utilizing plastic tubes having appropriate static and dynamic frictional characteristics, can readily function both as a means of retaining the two shank portions in the requisite disposition with respect to one another and provide resistance to unintended rotational displacement.

The preferred embodiment of the principles relating to the present invention illustrated in FIGS. 5–7, with regard to the construction of the medial axial pivot 13, illustrates separate, dedicated fulfillments of retention and locking means. As clearly seen in FIGS. 6 & 7, one shank end possesses a reduced exterior diameter 23 circumscribed by an annular groove 27 further interrupted by a through bore effecting two opposed apertures or notches 28 which may be readily replaced by two, opposed concavities. The other shank end comprising the exterior sleeve, as clearly seen in the end view given in FIG. 7*c*, possesses one detent 26 directed radially inward and sized and shaped to engage either aperture or notch 28 as well as the annular groove 27. Engagement by the detent 26 with the annular groove 27 effects a means of retention and engagement with either opposed aperture or notch 28 effects a means of releasable locking of the two shank portions with respect to each other rotationally about the shared longitudinal axis of the shank 20. As illustrated in FIGS. 5 & 7, it is further noted that the detent 26 radially inward from the sleeve is further given a radial resilience with respect to the common axis by virtue of the two slits 25 given the tube end along either side of the detent 26.

Since the two basic configurations of a preferred embodiment of the principles relating to the present invention are found in full opposition in relation to each other rotationally, ie. 180 degrees apart, it is necessary that two opposed notches 28 as clearly seen in FIG. 7*b* be provided for either one or two opposed detents 26 as illustrated in FIGS. *7c, 7a,* respectively. Two opposed detents 26 will, obviously, provide greater resistance to unintentional displacement, rotationally or longitudinally, than a single detent 26 of the same construction but will be less easily operated. Other means of effecting axially rotatable retention and means of releasable locking may be readily devised by one practiced in the art.

It is further noted that the relative lengths of the two portions comprising the shank 20, the radius of curvature of each arcuate portion 15, the basic handle diameter 19 and other dimensional considerations are dependent upon the range of dimensions of the human anatomy and the desired ability of the brush to facilitate manual scrubbing of one's back in the closed, U shaped configuration and facilitate manual scrubbing of the lower extremities in the open, S shaped configuration. The quarter circle arc described by each arcuate portion 15 illustrated in the attached drawings effects a parallel relation between the bristles 12 and the handle 11, which is considered desirable as necessary to a 'natural feel' or, more technically, the direct opposition of the reactive forces involved which enables a more easily maintained dynamic balance.

If a basically tubular, plastic construction of an embodiment of the principles relating to the present invention is made, other dimensions, such as that of the sleeve inner diameter 29, clearly seen in FIG. *7a,* will be considered. It is desirable in the constructions illustrated in FIGS. 5–7 that the reduced diameter 23 measure slightly less than the sleeve inner diameter 29 in order to permit rotation and effectively maintain the relation of each shank portion to each other with regard to the common longitudinal axis. The fit between the reduced diameter 23 and the sleeve inner diameter 29 is, in this construction, of concern. The coefficients of friction for the material deployed are also relevant in this regard. Lastly, the strength of the material, particularly with regard to shear, the wall thickness and the basic diameter 19 utilized are of obvious concern in design.

The foregoing is intended to enable a thorough understanding of the principles relating to the present invention so that one practiced in the art may construct a device and use the same in accordance with said principles and is to be regarded in no manner as restrictive of either the rights and privileges granted or of the scope of the intellectual property secured by granting of Letters Patent for which I hereby claim:

1. A brush having two ends intended to provide multiple configurations for manual use in a shower comprising:

a handle proximate one said end, a brush base possessing a bristled face proximate the other said end, a shank possessing a longitudinal axis extending between said handle and said brush base and further possessing an axial pivot therebetween;

said shank being comprised of two rigid portions, one said portion comprising a handle portion extending from said handle to said axial pivot, the other said portion comprising a brush portion extending from said brush base to said axial pivot;

said axial pivot possessing means of retaining both said shank portions in a continuous axial relation to each other and enabling rotation of each said shank portion with respect to the other about said longitudinal shank axis;

said handle shank portion further possessing an arcuate portion medial to said axial pivot and said handle, said brush shank portion possessing an arcuate portion medial to said axial pivot and said brush base, each said arcuate shank portion further substantially describing a quarter circle thereby enabling said bristled face to be aligned parallel to said handle in two opposed configurations, one open, S shaped configuration and one closed, U shaped configuration;

rotation of one said shank portion about said longitudinal axis with respect to said other shank portion thereby effecting multiple brush configurations.

2. A brush in accordance with claim 1 wherein said handle possesses a diameter which is relatively large to a person's grasp for comfort in gripping.

3. A brush in accordance with claim 2 wherein said handle exterior further possesses a plurality of ridges disposed normal to the longitudinal axis of said handle.

4. A brush in accordance with claim 1 further possessing positive means of resistance against unintended rotation other than friction maintaining said two shank portions in a fixed rotational relation to each other, thus enabling locking of said brush in two opposed configurations substantially one hundred eighty degrees apart rotationally from each other.

5. A brush in accordance with claim 1 further possessing a juncture between said brush base and said brush shank portion comprising an axial pivot enabling rotation of said brush base about an extension of said longitudinal shank axis.

6. A brush in accordance with claim 5 further possessing positive means of resistance against unintended rotation maintaining said brush base and said brush shank portion in a fixed rotational relation to each other, thus enabling locking of said brush base and said bristled face in two opposed configurations substantially one hundred eighty degrees apart rotationally from each other.

7. A brush in accordance with claim 1 wherein said shank possesses substantially tubular construction.

8. A brush in accordance with claim 7 wherein said axial pivot between said two shank portions is substantially comprised of a reduced diameter shank end fitted into a sleeve comprised of the end of the other shank.

9. A brush in accordance with claim 7 possessing positive retention means comprised of a detent and an annular groove engagable by said detent.

10. A brush in accordance with claim 7 possessing positive means of resistance against unintended rotation maintaining said two shank portions in a fixed rotational relation to each other is comprised of a detent and at least two separate notches engagable by said detent.

11. A brush in accordance with claim 10 wherein two said notches are comprised of apertures effected by a bore through one said tubular shank portion normal said longitudinal shank axis.

12. A brush in accordance with claim 10 wherein said positive means of resistance against unintended rotation maintaining said two shank portions in a fixed rotational relation to each other is comprised of two detents and at least two separate notches engagable by said detent.

* * * * *